US012618310B1

(12) United States Patent
Avant et al.

(10) Patent No.: US 12,618,310 B1
(45) Date of Patent: May 5, 2026

(54) INTERVAL CONTROL VALVE WITH MODULAR SCREENS DOWNHOLE IN A WELLBORE

(71) Applicant: Halliburton Energy Services, Inc., Houston, TX (US)

(72) Inventors: Rhett Bradford Avant, Houston, TX (US); Andrew Penno, Singapore (SG); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/937,400

(22) Filed: Nov. 5, 2024

(51) Int. Cl.

| | |
|---|---|
| ***E21B 43/08*** | (2006.01) |
| ***E21B 33/124*** | (2006.01) |
| ***E21B 34/06*** | (2006.01) |
| ***E21B 43/04*** | (2006.01) |

(52) U.S. Cl.
CPC ..... *E21B 43/08* (2013.01); *E21B 33/124* (2013.01); *E21B 34/06* (2013.01); *E21B 43/04* (2013.01)

(58) Field of Classification Search
CPC ..... E21B 43/04; E21B 33/12; E21B 43/14; E21B 43/12; E21B 43/08; E21B 34/06; E21B 34/10
See application file for complete search history.

(56) References Cited

U.S. PATENT DOCUMENTS

| | | | | |
|---|---|---|---|---|
| 7,950,461 | B2 | 5/2011 | Schrader et al. | |
| 8,196,668 | B2 * | 6/2012 | Rytlewski | E21B 43/04 166/227 |
| 8,225,863 | B2 | 7/2012 | Hammer et al. | |
| 10,428,619 | B2 | 10/2019 | Poluchalla et al. | |
| 11,506,031 | B2 | 11/2022 | Greci et al. | |
| 2007/0144746 | A1 * | 6/2007 | Jonas | E21B 17/046 166/242.6 |
| 2012/0199346 | A1 * | 8/2012 | Patel | E21B 43/08 166/278 |
| 2014/0338922 | A1 | 11/2014 | Lopez et al. | |
| 2021/0148197 | A1 | 5/2021 | Green et al. | |
| 2022/0235628 | A1 | 7/2022 | Sayedakram et al. | |
| 2024/0125206 | A1 | 4/2024 | Zahur et al. | |

FOREIGN PATENT DOCUMENTS

| | | | |
|---|---|---|---|
| WO | 2014021899 | A1 | 2/2014 |

OTHER PUBLICATIONS

Application No. PCT/US2024/058678, International Search Report and Written Opinion, mailed On Jul. 22, 2025, 10 pages.

* cited by examiner

*Primary Examiner* — Zakiya W Bates
(74) *Attorney, Agent, or Firm* — Kilpatrick Townsend & Stockton, LLP

(57) ABSTRACT

A system can include a tubing string, a filter screen, and an interval control valve deployed downhole in a wellbore. The tubing string may not have perforations. A first annulus may be formed between an exterior of the tubing string and a subterranean formation. The filter screen can be coupled to the exterior of the tubing string and can form a second annulus between the filter screen and the exterior of the tubing string. The interval control valve can be positioned inline with the exterior of the tubing string. The interval control valve can control flow of fluid between the second annulus and the interior of the tubing string.

20 Claims, 4 Drawing Sheets

INTERVAL CONTROL VALVE WITH MODULAR SCREENS DOWNHOLE IN A WELLBORE

TECHNICAL FIELD

The present disclosure relates generally to interval control valves and, more particularly (although not necessarily exclusively), to interval control valves with modular screens downhole in a wellbore.

BACKGROUND

A wellbore can be formed in a subterranean formation for extracting produced hydrocarbon material and other suitable material. Various wellbore operations can be performed with respect to the wellbore. For instance, the wellbore operations can include drilling (e.g., forming the wellbore), stimulation (e.g., hydraulic fracturing or other similar stimulation operations), production operations, and other suitable wellbore operations. Devices may be deployed within the wellbore on a tubing string, such as downhole control valves. Downhole control valves can be controlled from a surface of the wellbore to control flow of downhole production fluids or gas, injected fluids or gas, fracturing fluids, and the like. For instance, downhole control valves can be used to open, close, or restrict one or more flow paths downhole in the wellbore to help manage or equalize downhole fluid flow.

DETAILED DESCRIPTION

Figure 1:
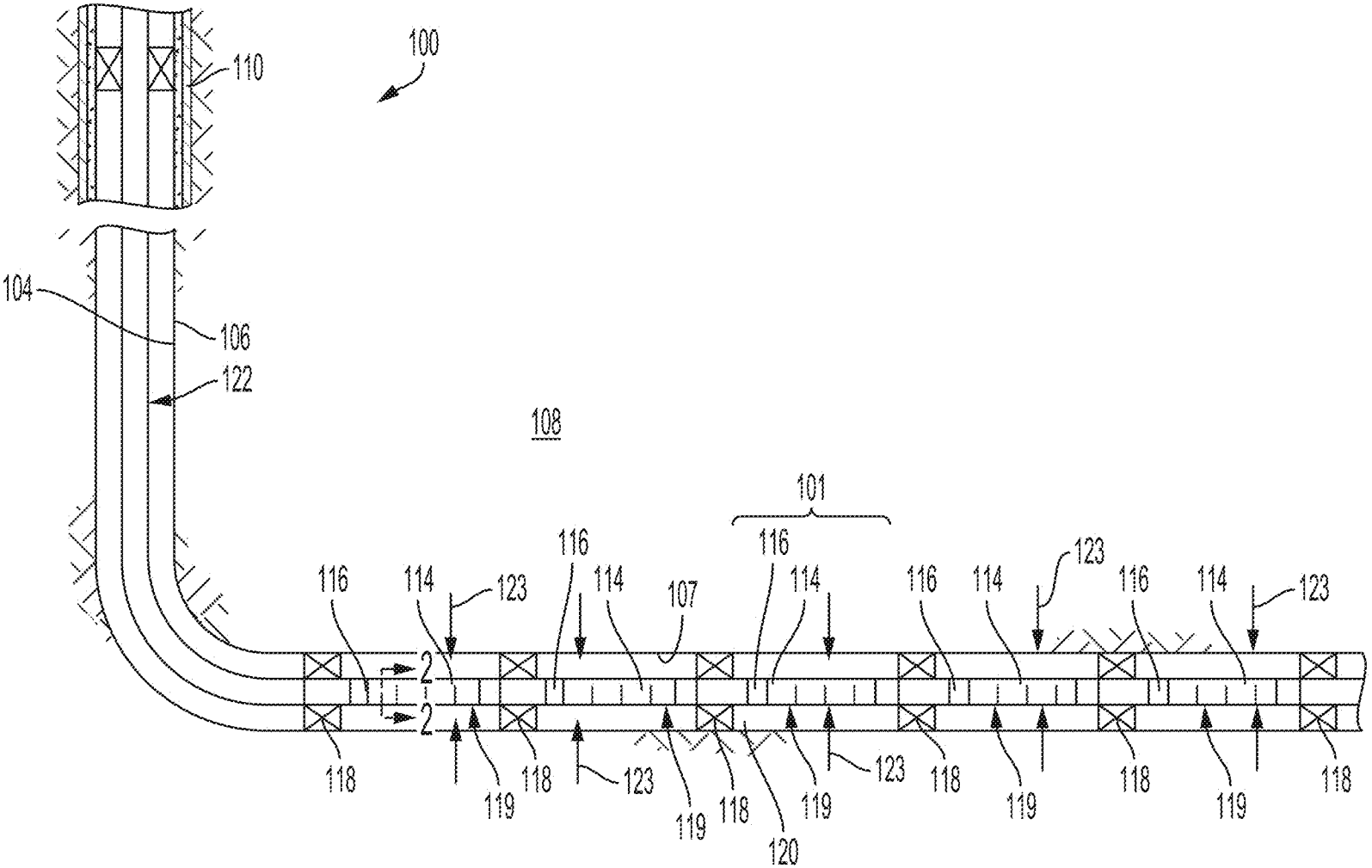
FIG. 1 is a schematic of a well system including an inline interval control valve system according to one example of the present disclosure.

Certain aspects and examples of the present disclosure relate to an interval control valve that is installed inline with a tubing string downhole in a wellbore. An installation of the interval control valve inline with a wall of the tubing string can mean that the interval control valve does not extend into the inner diameter of the tubing string and thus does not restrict the inner diameter at all, or that the interval control valve is not positioned within the tubing string as a separate device. The interval control valve can control fluid flow (e.g., of production fluid or other downhole fluids) from an annulus formed between an exterior of the tubing string and a filter screen that is coupled to the exterior of the tubing string. For example, a valve of the interval control valve can be actuated to prevent or allow fluid flowing through the annulus to enter the interior of the tubing string via an opening of the tubing string. Packers positioned uphole and downhole of the filter screen and interval control valve can form a fluid barrier or isolation zone. The tubing string may not have any perforations, and thus the only flow path into the tubing string (e.g., beneath the filter screen) may be through the interval control valve.

Positioning interval control valves inline with the tubing string can allow for any number of flow paths (e.g., one per interval control valve) to be created downhole. Conventional setups for wellsite systems with interval control valves that are not positioned inline with a tubing string may be limited to only two flow paths (e.g., annular flow and tubing flow). For instance, interval control valves may typically be installed inside of screened, perforated tubulars (e.g., extending into the inner diameter of the tubular). This configuration can limit the inner diameter of the system and therefore the flow area for produced or injected fluids or gas, as well as added complexity of the inner string while tubulars are run downhole. Other conventional techniques for increasing flow paths downhole may involve including a tubing string within an outer string, which additionally reduces inner diameter and increases complexity of inner string and difficulty (e.g., increased risk of damage, and rig time) in running the tubing strings downhole. By increasing the number of flow paths downhole using techniques described herein, greater control of fluid flow downhole and the reservoir can result in improved production metrics such as efficiency and increased flow area for the produced fluids. Additionally, by positioning the interval control valve inline with the exterior of the tubing string such that the components of the interval control valve are not positioned within the interior of the tubing string (e.g. in an inner region defined by an inner surface of the wall of the tubing string), techniques described herein can enable full bore inner diameter and increased simplicity of the inner string compared to conventional techniques.

In a particular example, an interval control device can be installed inline with an exterior of a tubing string that is deployed downhole. The tubing string may not be perforated. Instead, the tubing string may be made of tubing joints that are coupled, such as with threaded couplings. Any number of modular screen filters can be attached to the tubing string to filter production fluid (or other kinds of downhole fluid) over a long length of subterranean formation. One or more filter screens can be isolated in fluid isolation zones by inflatable packers. The subterranean formation can form a first annulus with the exterior of the tubing string and/or the filter screen. Production fluid can flow from the subterranean formation into the first annulus.

The filter screen can additionally form a second annulus between the interior of the filter screen and the exterior of the tubing string (e.g., at which the interval control valve is installed inline). Because the packers form a fluid isolation zone, the production fluid can pass from the first annulus, through the filter screen, and into the second annulus. The interval control valve can control flow of the production fluid from the second annulus into the interior of the tubing string. For example, the interval control valve can include a sleeve that can be shifted to open or close an opening to the interior of the tubing string. Actuation of the sleeve can be controlled via a control line extending from a surface of the wellbore downhole to the interval control valve or wirelessly via remote control (acoustically, electro-magnetically, or other such means of telemetry). The interval control valve can be mechanically controlled, electronically controlled, hydraulically controlled, or electro-hydraulically controlled.

In some examples, multiple filter screens or multiple interval control valves can be positioned within a single fluid isolation zone in the wellbore. This can create multiple flow paths (e.g., one per interval control valve) per fluid isolation zone.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 including an inline interval control valve system 101 according to one example of the present disclosure. The well system 100 may include a wellbore 106 with a generally vertical section 104 that transitions into a generally horizontal section 107 extending through a subterranean formation 108. In an example, the vertical section 104 may extend in a downhole direction from a portion of the wellbore 106 having been cemented in casing string 110. A tubular string, such as a production tubing string 122, may be installed or extended into the wellbore 106.

One or more inline interval control valve systems 101 may be installed along the tubing string 122, such as along tubulars 119 positioned along the horizontal section 107 of the wellbore 106. The interval control valve systems 101 may include one or more filter screens 114, one or more interval control valves 116, and other components depicted and described in further detail below in relation to FIG. 2. Packers 118 may seal off an annulus 120 located between the tubulars 119 and walls of the wellbore 106. As a result, fluids 123 may be produced from multiple intervals or "pay zones" of the formation 108 through isolated portions of the annulus 120 between adjacent pairs of packers 118.

In some examples, inline interval control valve systems 101 (e.g., including a filter screen 114 and an interval control valve 116) may be interconnected in the tubing string 122. The filter screens 114 may be any type of sand screen that can couple to the tubulars 119, such as by using a composite resin or other chemical binding agent, or via welding, mechanical swagging, or elastomeric seals. The filter screens 114 can create another annulus between the filter screens and the tubing string 122, as the tubing string 122 may be a solid (e.g., non-perforated) tubing string 122. The interval control valve 116 can control flow of the fluid from the annulus between the filter screens and the exterior of the tubing string 122 into the interior of the tubing string 122. Components of the interval control valve system 101 are described in further detail below with reference to FIG. 2.

Figure 2:
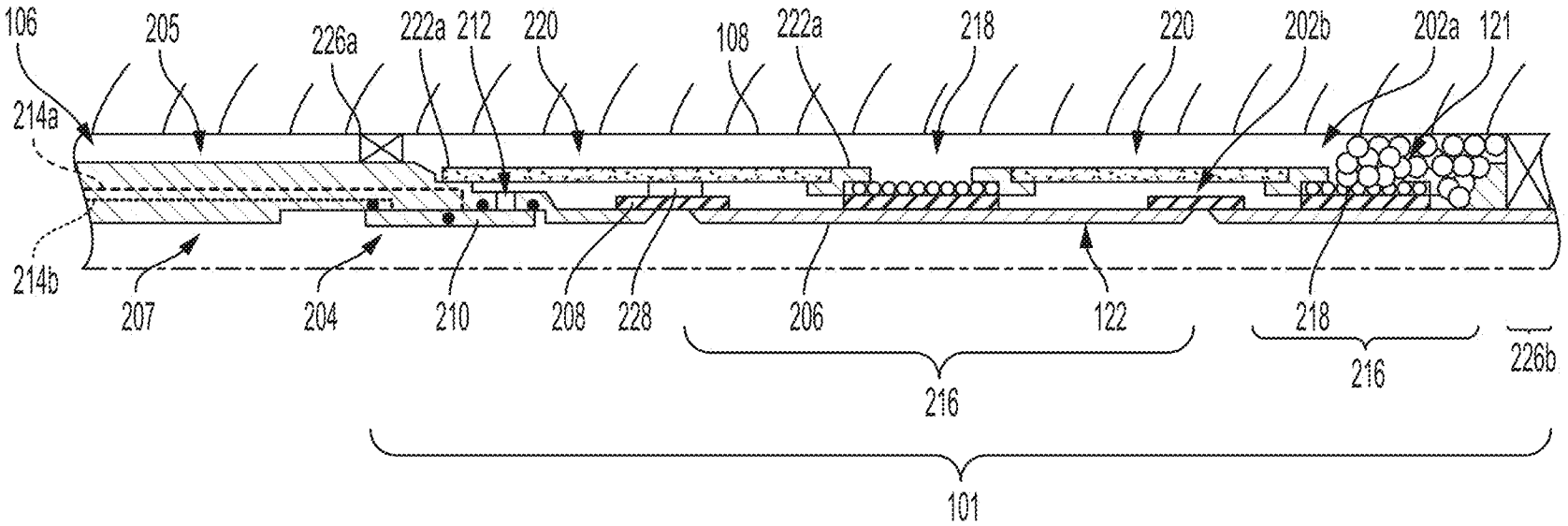
FIG. 2 is a diagram of an inline interval control valve system downhole in a wellbore according to one example of the present disclosure.

FIG. 2 is a diagram of an inline interval control valve system 101 coupled to a tubing string 122 positioned downhole in a wellbore 106 according to one example of the present disclosure. The interval control valve system 101 can include an interval control valve 204, one or more filter screens 218, and in some examples one or more shrouds 220 and/or an autonomous interval control device 228. The tubing string 122 may be a tubing string 122 that is deployed downhole in the wellbore 106 that is drilled into a subterranean formation 108. Production fluid may flow from the subterranean formation into a first annulus 202*a* formed between the subterranean formation 108 and the tubing string 122 (and/or the inline interval control valve system 101). The tubing string 122 may be non-perforated. Instead of having a perforated surface, the tubing string 122 may include tubing joints 206 that are joined together via joint couplings 208. The joint couplings 208 in some examples may be threaded connections.

The interval control valve system 101 can include an interval control valve 204 that can be installed inline with the exterior 205 of the tubing string 122, such as in a lower completion zone of the tubing string 122. "Inline" can be defined herein as installing the interval control valve 204 within a wall of the tubing string 122 such that the components of the interval control valve 204 extend not at all or minimally into the interior 207 of the tubing string 122. Thus, the interval control valve 204 may not restrict the inner flow area of the interior 207 of the tubing string 122. The interval control valve 204 can include a sleeve 210 that can be linearly actuated to cover or block an opening 212 in the tubing string 122. The sleeve 210 can be actuated from a surface of the wellbore 106 via one or more control lines 214*a-b* extending uphole. For example, the interval control valve 204 may be hydraulically controlled by a first control line 214*a* (e.g., hydraulic line) applying pressure and displacing fluid. The displaced fluid may be returned by the second control line 214*b* (e.g., another hydraulic line). In another example, the interval control valve 204 may be electrically controlled by one or more control lines 214*a-b* (e.g., electrical lines with couplings). Or, the interval control valve 204 may be electro-hydraulically controlled with a combination of electrical lines and hydraulic lines. Any other control lines coupled to downhole sensors or other downhole tools may also be included. In other examples, the interval control valve 204 may not be controlled by control lines 214*a-b*. Instead, the interval control valve 204 may be wirelessly controlled or may be an autonomously controlled interval control valve.

Although the interval control valve 204 depicted in FIG. 2 includes a sleeve 210 that is linearly actuated to close or open a flow path (e.g., through the opening 212), any other suitable type of interval control valve that can be installed inline with the exterior 205 of the tubing string 122 (e.g., not extending into the interior 207 of the tubing string 122) may be used instead. For example, the interval control valve 204 can be or include a needle valve, a gate valve, a rotating sleeve, a ball valve, or the like.

The interval control valve system 101 can further include one or more modular screen joints 216. A modular screen joint 216 can include a filter screen 218 and a shroud 220. The filter screen 218 can be a mesh filter, a wire wrap filter, a slotted liner, or any other suitable filter, such as a filter of a type typical to oil field sand control practices. The filter screen 218 can be positioned on an exterior 205 of the tubing string 122. In some examples, each end of the filter screen 218 may be coupled to the exterior 205 of the tubing string 122. In other examples, shrouds 220 may be coupled to one or both ends of the filter screen 218. For example, as depicted in FIG. 2, a first end 222*a* of the shroud 220 can be coupled to the filter screen 218 and a second end 222*b* of the shroud 220 can be coupled (e.g., welded) to a portion of the exterior 205 of the tubing string 122. The modular screen joints 216 (e.g., the shrouds 220 and filter screens 218) can define a second annulus 202*b* between the modular screen joints 216 and the exterior 205 of the tubing string 122. The shrouds 220 can prevent production within the second annulus 202*b* from flowing back into the first annulus 202*a*.

In some examples, the modular screen joints 216 may not include the shrouds 220 and may only include a filter screen 218 with a first end coupled to the tubing string 122 and a second end coupled to another portion of the tubing string 122. In such examples, the second annulus 202*b* may only be formed by the filter screen 218. Or, multiple filter screens 218 may be coupled together to form the second annulus 202*b*. In other examples, the modular screen joints 216 may include one or more filter screens 218 coupled to one or more shrouds 220. The shrouds 220 may also form the second annulus 202*b* and may extend the length of the second annulus 202*b*. It may be beneficial to include the shrouds 220 in the modular screen joints 216 to aid in assembling the tubing string 122. For example, when assembling components such as the tubing joints 206 and the joint couplings 208 of the tubing string 122, the shrouds 220 coupled to the tubing joints 206 can be easily moved out of the way to connect the components. In contrast, conventional dual string systems (e.g., used to increase number of flow paths downhole) may be assembled by inserting a first tubing string within a second tubing string, which may reduce the usable inner diameter of downhole tubing strings and result in increased complexity of running tubing strings downhole.

In some examples, the shrouds 220 may be made of a solid, non-perforated material. The material of the shrouds 220 may be a relatively light, sand-tight material. In other examples, the shrouds 220 may not be solid and may include perforations, openings, slots, or the like. The openings, slots, perforations, etc. of the shrouds 220 may in some examples be no larger than the openings of the filter screen 218. For example, perforations of the shroud 220 may prevent solids in the production fluid from entering the second annulus 202*b*.

Packers 226*a-b* can be set downhole to form a fluid isolation zone in the wellbore 106 within the first annulus 202*a*. The one or more modular screen joints 216 can be positioned within the fluid isolation zone created by the packers 226*a-b*. For example, a first packer 226*a* can be positioned in the first annulus 202*a* uphole from the modular screen joints 216 and the sleeve 210 of the interval control valve 204. A second packer 226*b* can be positioned in the first annulus 202*a* downhole from the modular screen joints 216 and the sleeve of the interval control valve 204. The packers 226*a-b* can, in some examples, be inflatable packers that can inflate to create the fluid isolation zone. Example lengths of the fluid isolation zone can be between 50 feet and 1,000 feet, but any suitable length of fluid isolation zone can be used. Example lengths of the filter screens 218 can be 20 feet to 40 feet long. Although only two packers 226*a-b* are depicted in FIG. 2, more packers may be included along the length of the tubing string 122 to define additional fluid isolation zones. In some examples, sections of filtered tubing joints may be replaced with fluid-tight shrouds along packers to isolate fractures or other non-desirable areas of the wellbore 106, while still including tubing joints on either side of the fracture that is producing through the same interval control valve.

The fluid isolation created by the packers 226*a-b* can cause the production fluid from the subterranean formation 108 to flow through the first annulus 202*a* and through the filter screen 218 of the modular screen joint 216 (e.g., to filter out solids in the production fluid) into the second annulus 202*b*. Because the tubing string 122 is non-perforated and the packers 226*a-b* form the fluid isolation zone, the only flow path into the tubing string 122 for the production fluid can be through the opening 212 of the interval control valve 204. In some examples, multiple interval control valves can be included in the same fluid isolation zone, thus creating multiple flow paths.

In some examples, the first annulus 202*a* may further include a gravel pack 121 that can be pumped or otherwise placed downhole. For example, after the tubing string 122 and the interval control valve system 101 are run downhole, a slurry of fluid and gravel can be pumped into the first annulus 202*a*. The slurry can then be dehydrated to remove the fluid. The remaining gravel (e.g., that cannot pass through the filter screens 218) can form the gravel pack 121. In other examples, the filter screens 218 can come prepacked with the gravel pack 121. Thus, the gravel pack 121 may be run downhole in conjunction with the tubing string 122 and the interval control valve system 101. The gravel pack 121 can be used to filter solids out of the production fluid before the production fluid is further filtered through the filter screens 218 into the second annulus 202*b*.

In some examples, the interval control valve system 101 can further include one or more autonomous interval control devices (aICDs) 228. The aICD 228 can further control flow of the production fluid into the interior 207 of the tubing string 122 in conjunction with the interval control valve 204. For example, the aICD 228 can autonomously restrict undesired fluids from flowing into the interior 207 of the tubing string 122. In the example depicted in FIG. 2, production fluid may flow into the second annulus 202*b* through the filter screen 218 in a leftward direction. The aICD 228 may restrict flow of the production fluid in the second annulus 202*b* from reaching the opening 212 controlled by the interval control valve 204. The aICD 228 may include another opening that can allow only certain kinds of fluids to pass through the aICD 228 towards the opening 212 controlled by the interval control valve 204. In one example where the wellbore 106 is in an oil well, the aICD 228 can autonomously prevent water or gas in the production fluid from flowing into the tubing string 122. The aICD 228 can allow oil to pass through the aICD 228 towards the interval control valve 204 and into the interior 207 of the tubing string 122 via the opening 212. In another example where the wellbore 106 is in a gas well, the aICD 228 can autonomously prevent water or oil from flowing into the tubing string 122. The aICD 228 can allow gas to pass through the aICD 228 towards the interval control valve 204 and into the interior 207 of the tubing string 122 via the opening 212. The aICD 228 may autonomously restrict undesired fluids based on fluid density, fluid viscosity, or other suitable fluid characteristics. Although the aICD 228 is depicted in FIG. 2 as being positioned on a joint coupling 208, in other examples the aICD 228 can be positioned at any location within the second annulus 202*b*.

In some examples, multiple interval control valve systems 101 can be positioned along the tubing string 122 (e.g., within separate fluid isolation zones created by additional packers). In such examples, the control lines 214*a-b* may in some cases run over an uphole interval control valve system to reach a downhole interval control valve system. Thus, the packers 226*a-b* may in some examples be swell packers that can include feedthroughs through which the control lines 214*a-b* can extend to reach a downhole interval control valve system. The packers 226*a-b* may swell to expand around and seal the control lines 214*a-b* extending through the feedthroughs. In other examples, the control lines 214*a-b* may be run through the tubing string 122.

Additionally, the control lines 214*a-b* may in some examples run over an uphole shroud 220 and/or filter screen 218 to reach a downhole interval control valve. The exterior of the shrouds 220 and/or filter screens 218 may therefore, in some examples, include channels through which the control lines 214*a-b* may extend. Or, centralizers may be clamped on top of the control lines 214*a-b* running over the exterior of the shrouds 220 and/or filter screens 218.

Figure 3:
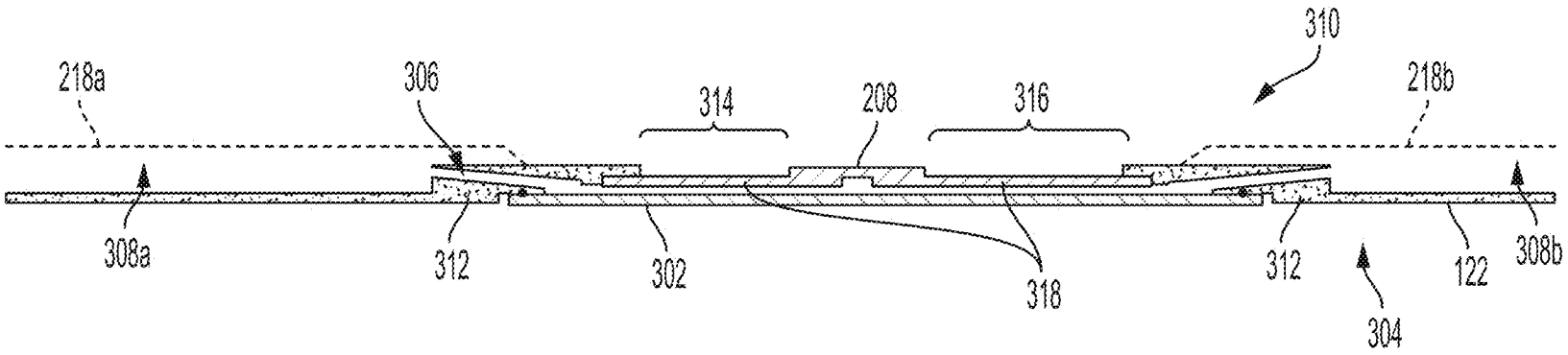
FIG. 3 is a diagram of another inline interval control valve system downhole in a wellbore according to one example of the present disclosure.

FIG. 3 is a diagram of filter screens 218*a-b* with inner shrouds 302 downhole in a wellbore 106 according to one example of the present disclosure. In the example depicted in FIG. 3, rather than including shrouds on the outside of the tubing string 122 (e.g., as depicted in FIG. 2), an inner shroud 302 can be included on the interior 304 of the tubing string 122. That is, the inner shroud 302 may not or may minimally reduce the inner diameter of the tubing string 122. The inner shroud 302 may not be a new string of pipe installed on the tubing string 122. Instead, each end of the inner shroud 302 may be coupled to a cross-over connection 312 coupled to ends of tubing joints in the tubing string 122.

The inner shroud 302 can create a fluidic pathway 306 from a first filtered annulus 308*a* created by a first filter screen 218*a* and a second filtered annulus 308*b* created by a second filter screen 218*b*. The inner shroud 302 may form the fluidic pathway 306 with a joint coupling 208, which may in some examples be coupled to the tubing string 122 on the rig floor. The joint coupling 208 can include short tubing sections 318 in a pin handling space 314 and a box handling space 316. The filter screens 218*a-b* may be positioned on an exterior 310 of the tubing string 122. The filtered annuluses 308*a-b* can be an example of the first annulus 202*a* of FIG. 2. The fluidic pathway 306 created by the inner shroud 302 can allow fluid to flow from a first interval valve control system (e.g., that includes the first filter screen 218*a*) to a second interval valve control system (e.g., that includes the second filter screen 218*b*). In such examples, the inner shroud 302 may not extend along the full length of a tubing joint. Instead, the inner shroud 302 may only be long enough to extend from the first filtered annulus 308*a* to the second filtered annulus 308*b*.

Although the components and techniques of FIGS. 1-3 are described herein with respect to completion operations and production operations, in other examples the interval control valve system 101 described herein can be similarly and equivalently used for any suitable downhole wellbore operations. In some examples, the interval control valve system 101 can be used in performing fracturing operations. For example, a valve (not pictured) on the surface of the wellbore 106 can be closed and fracturing fluid can be pumped at a relatively high pressure into the wellbore 106 using the interval control valve system 101. In some examples, fluid may be pumped into the wellbore 106 via the tubing string 122. Such fluid may then pass through the opening 212 controlled by the interval control valve 204 into the second annulus 202*b*. Then, the fluid may flow from the second annulus 202*b* through the filter screen 218 and into the first annulus 202*a*.

Figure 4:
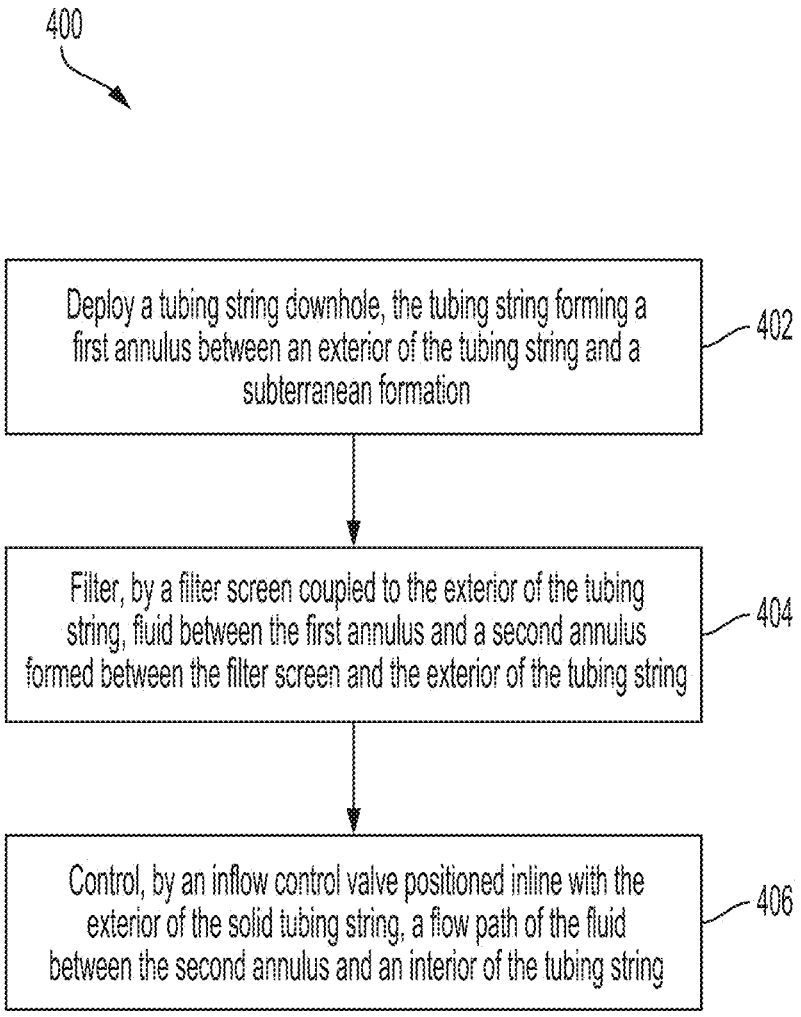
FIG. 4 is a flow chart of a process for using an inline interval control valve and modular filter screens downhole in a wellbore according to one example of the present disclosure.

FIG. 4 is a flow chart of a process 400 for using an inline interval control valve and modular filter screens downhole in a wellbore according to one example of the present disclosure. In other examples, the process 400 can include more steps, fewer steps, different steps, or a different order of the steps depicted in FIG. 4. The steps of FIG. 4 are described below with reference to the components discussed above in FIGS. 1-3.

At block 402, the process 400 involves deploying a tubing string 122 downhole in a wellbore 106. The tubing string 122 can form a first annulus 202*a* between an exterior 205 of the tubing string 122 and a subterranean formation 108 into which the wellbore 106 is drilled. In some examples, after the tubing string 122 has been run in hole, a fluid isolation zone can be created for a section of the tubing string 122 in the wellbore 106. For example, the tubing string 122 may include an interval control valve 204 that is installed inline with the exterior 205 of the tubing string 122. The tubing string 122 may also include a filter screen 218 that is coupled to an exterior 205 of the tubing string 122. The filter screen 218 and/or a shroud 220 extending a covering of the tubing string 122 may cover an opening 212 in the tubing string 122 that is controlled by the interval control valve 204. The filter screen 218 and/or the shroud 220 may form a second annulus 202*b* between the exterior 205 of the tubing string 122 and the underside of the filter screen 218 and/or the shroud 220.

To create a fluid isolation zone and cause the opening 212 controlled by the interval control valve 204 to be the only flow path into (or out of) the tubing string 122 for production fluid in the fluid isolation zone, packers 226*a-b* can be set downhole. For example, a first packer 226*a* can be set uphole from the interval control valve 204 and the filter screen 218. A second packer 226*b* can be set downhole from the interval control valve 204 and the filter screen 218. The packers 226*a-b* can, for example, be inflated to prevent production fluid in the first annulus 202*a* from flowing above the first packer 226*a* or below the second packer 226*b*.

In some examples, a gravel pack 121 can be positioned downhole. The gravel pack 121 can be placed by pumping a slurry of fluid (e.g., water, oil, or viscous fluid) and gravel into the first annulus 202*a*. The fluid in the slurry can be dehydrated, leaving gravel to form the gravel pack 121. The gravel pack 121 may in some examples filter production fluid flowing from the subterranean formation 108 into the first annulus 202*a*. For example, the gravel pack 121 may filter out solids from the production fluid before said production fluid reaches the filter screen 218.

At block 404, the process 400 involves filtering, by the filter screen 218 coupled to the exterior 205 of the tubing string 122, fluid between the first annulus 202*a* and the second annulus 202*b* formed between the filter screen 218 and the exterior 205 of the tubing string 122. Examples of the filter screen 218 can include slotted liners, mesh filters, wire wrap filters, etc. In some examples, multiple filter screens 218 may be coupled to the exterior 205 of the tubing string 122 in the fluid isolation zone. For example, a first filter screen and a second filter screen may each be coupled to the exterior 205 of the tubing string 122, such as to the same tubing joint 206 of the tubing string 122. The first filter screen and the second filter screen may be paired with a single interval control valve or multiple interval control valves. The second annulus 202*b* may be a flow area underneath the filter screen 218 (and, in some examples, the shroud 220 extending across the exterior 205 of the tubing string 122). The second annulus 202*b* formed by the filter screen 218 and/or shroud 220 can cover the opening 212 of the tubing string 122 that is controlled by the interval control valve 204.

At block 406, the process 400 involves controlling, by an interval control valve 204 positioned inline with the exterior 205 of the tubing string 122, a flow path of the fluid between the second annulus 202*b* and an interior 207 of the tubing string 122. For example, the interval control valve 204 can include a sleeve 210 that can be linearly actuated to cover (e.g., block the flow path) or expose (e.g., allow the flow path) the opening 212 of the tubing string 122. Actuation of the sleeve 210 can be controlled from the surface of the wellbore 106 via one or more control lines 214*a-b* extending from the surface. If the sleeve 210 is exposing the opening 212, production fluid within the second annulus 202*b* can flow into the interior 207 of the tubing string 122. In some examples, the fluid isolation zone may include a single interval control valve or multiple interval control valves. Each interval control valve may control a single flow path of production fluid into the tubing string 122.

In some aspects, system, method, and apparatus for inline interval control valves with modular filter screens downhole are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubing string positionable downhole in a wellbore and forming a first annulus between an exterior of the tubing string and a subterranean formation of the wellbore when positioned downhole; a filter screen coupleable to the exterior of the tubing string and configurable to form a second annulus between the filter screen and the exterior of the tubing string; and an interval control valve positionable inline with the exterior of the tubing string and configurable to control flow of fluid between the second annulus and an interior of the tubing string.

Example 2 is the system of example(s) 1, further comprising: a first packer positionable in the first annulus uphole from the filter screen and the interval control valve; and a second packer positionable in the first annulus downhole from the filter screen and the interval control valve, wherein the first packer and the second packer are configurable to form a fluid isolation zone for the first annulus.

Example 3 is the system of any of example(s) 1-2, wherein the filter screen is a first filter screen and the interval control valve is a first interval control valve, wherein the interval control valve is configurable to control a first flow path of fluid between the second annulus and the interior of the tubing string, and wherein the system further comprises: a second filter screen coupleable to a same tubing joint of the tubing string as the first filter screen, wherein a third annulus is formed between the second filter screen and the exterior of the tubing string, wherein the second filter screen is configurable to filter fluid between the first annulus and the third annulus; and a second interval control valve positionable inline with the exterior of the tubing string and configurable to control a second flow path of fluid between the third annulus and the interior of the tubing string, wherein the second filter screen and the second interval control valve are positionable within the fluid isolation zone between the first packer and the second packer.

Example 4 is the system of any of example(s) 1-3, further comprising: one or more control lines extendable from a surface of the wellbore to the interval control valve positionable downhole in the wellbore, wherein the one or more control lines are configurable to control actuation of the interval control valve.

Example 5 is the system of any of example(s) 1-4, further comprising: a shroud positionable on the exterior of the tubing string and further configurable to form the second annulus, wherein the shroud comprises: a first end coupleable to the filter screen; and a second end coupleable to a portion of the tubing string proximate the interval control valve.

Example 6 is the system of any of example(s) 1-5, wherein the tubing string is a solid tubing string.

Example 7 is the system of any of example(s) 1-6, further comprising: a gravel pack positionable within the first annulus between the subterranean formation and the filter screen.

Example 8 is a method comprising: deploying a tubing string downhole in a wellbore, the tubing string forming a first annulus between an exterior of the tubing string and a subterranean formation; filtering, by a filter screen coupled to the exterior of the tubing string, fluid between the first annulus and a second annulus formed between the filter screen and the exterior of the tubing string; and controlling, by an interval control valve positioned inline with the exterior of the tubing string, a flow path of the fluid between the second annulus and an interior of the tubing string.

Example 9 is the method of example(s) 8, further comprising: deploying a first packer in the first annulus uphole from the filter screen and the interval control valve; deploying a second packer in the first annulus downhole from the filter screen and the interval control valve; and forming, by the first packer and the second packer, a fluid isolation zone for the first annulus and the second annulus.

Example 10 is the method of any of example(s) 8-9, wherein the filter screen is a first filter screen, the flow path is a first flow path, and the interval control valve is a first interval control valve, and whether the method further comprises: filtering, by a second filter screen coupled to a same tubing joint of the tubing string as the first filter screen, fluid between the first annulus and a third annulus formed between the second filter screen and the exterior of the tubing string; and controlling, by a second interval control valve positioned inline with the exterior of the tubing string, a second flow path of the fluid between the third annulus and the interior the tubing string, wherein the second filter screen and the second interval control valve are within the fluid isolation zone between the first packer and the second packer.

Example 11 is the method of any of example(s) 8-10, further comprising: controlling, by one or more control lines extending from a surface of the wellbore to the interval control valve, actuation of the interval control valve to control flow of fluid into the tubing string.

Example 12 is the method of any of example(s) 8-11, further comprising: coupling a first end of a shroud positioned on the exterior of the tubing string to the filter screen; and coupling a second end of the shroud to a portion of the tubing string proximate the interval control valve, wherein the shroud further forms the second annulus.

Example 13 is the method of any of example(s) 8-12, wherein the shroud comprises filter openings or slots.

Example 14 is the method of any of example(s) 8-13, further comprising: positioning a gravel pack downhole within the first annulus between the subterranean formation and the filter screen.

Example 15 is an interval control valve system comprising: a filter screen coupleable to an exterior of a tubing string that is positionable downhole in a wellbore, the tubing string configurable to form a first annulus between the exterior of the tubing string and a subterranean formation when positioned downhole, the filter screen configurable to form a second annulus between the filter screen and the exterior of the tubing string; and an interval control valve positionable inline with the exterior of the tubing string and configurable to control flow of fluid between the second annulus and an interior of the tubing string.

Example 16 is the interval control valve system of example(s) 15, wherein a first packer and a second packer are configurable to form a fluid isolation zone for the first annulus and the second annulus, wherein the first packer is positionable in the first annulus uphole from the filter screen and the interval control valve, and wherein the second packer is positionable in the first annulus downhole from the filter screen and the interval control valve.

Example 17 is the interval control valve system of any of example(s) 15-16, wherein the filter screen is a first filter screen and the interval control valve is a first interval control valve, wherein the interval control valve is configurable to control a first flow path of fluid between the second annulus and the interior of the tubing string, and wherein the interval control valve system further comprises: a second filter screen coupleable to a same tubing joint of the tubing string as the first filter screen, wherein a third annulus is formed between the second filter screen and the exterior of the tubing string, wherein the second filter screen is configurable to filter fluid between the first annulus and the third annulus; and a second interval control valve positioned inline with the exterior of the tubing string and configurable to control a second flow path of fluid between the third annulus and the interior of the tubing string, wherein the second filter screen and the second interval control valve are positionable within the fluid isolation zone between the first packer and the second packer.

Example 18 is the interval control valve system of any of example(s) 15-17, further comprising: one or more control lines extendable from a surface of the wellbore to the interval control valve positionable downhole in the wellbore, wherein the one or more control lines are configurable to control actuation of the interval control valve.

Example 19 is the interval control valve system of any of example(s) 15-18, further comprising: a shroud positionable on the exterior of the tubing string and further configurable to form the second annulus, wherein the shroud comprises: a first end coupleable to the filter screen; and a second end coupleable to a portion of the tubing string proximate the interval control valve.

Example 20 is the interval control valve system of any of example(s) 15-19, wherein the shroud further comprises filter openings or slots.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing string positionable downhole in a wellbore and forming a first annulus between an exterior of the tubing string and a subterranean formation of the wellbore when positioned downhole;

a first filter screen coupleable to the exterior of a first tubing joint of the tubing string and configurable to form a second annulus between the first filter screen and the exterior of the first tubing joint;

an interval control valve positionable inline with the exterior of the tubing string and configurable to control flow of fluid between the second annulus and an interior of the tubing string;

a second filter screen coupleable to the exterior of a second tubing joint of the tubing string and configurable to form a third annulus between the second filter screen and the exterior of the second tubing joint; and a shroud positionable on the exterior of the tubing string, the shroud comprising:

a first end coupleable to the first filter screen; and a second end coupleable to the second filter screen to form a fluidic pathway between the second annulus and the third annulus.

2. The system of claim 1, further comprising:

a first packer positionable in the first annulus uphole from the first filter screen and the interval control valve; and a second packer positionable in the first annulus downhole from the first filter screen and the interval control valve, wherein the first packer and the second packer are configurable to form a fluid isolation zone for the first annulus.

3. The system of claim 2, wherein the interval control valve is a first interval control valve, wherein the first interval control valve is configurable to control a first flow path of fluid between the second annulus and the interior of the tubing string, and wherein the system further comprises:

a third filter screen coupleable to a same tubing joint of the tubing string as the first filter screen, wherein a fourth annulus is formed between the third filter screen and the exterior of the tubing string, wherein the third filter screen is configurable to filter fluid between the first annulus and the fourth annulus; and a second interval control valve positionable inline with the exterior of the tubing string and configurable to control a second flow path of fluid between the fourth annulus and the interior of the tubing string, wherein the third filter screen and the second interval control valve are positionable within the fluid isolation zone between the first packer and the second packer.

4. The system of claim 1, further comprising:

one or more control lines extendable from a surface of the wellbore to the interval control valve positionable downhole in the wellbore, wherein the one or more control lines are configurable to control actuation of the interval control valve.

5. The system of claim 1, wherein the tubing string is a solid tubing string.

6. The system of claim 1, further comprising:

a gravel pack positionable within the first annulus between the subterranean formation and the first filter screen.

7. The system of claim 1, wherein the shroud is a first shroud and the fluidic pathway is a first fluidic pathway, and wherein the system further comprises:

a second shroud positionable on an interior of the tubing string to form a second fluidic pathway between the second annulus and the third annulus.

8. The system of claim 7, wherein the second shroud further comprises:

a first end coupled to the first tubing joint; and a second end coupled to the second tubing joint, wherein the fluidic pathway is formed between the first end and the second end.

9. The system of claim 1, wherein the shroud comprises a non-perforated material.

10. A method comprising:

deploying a tubing string downhole in a wellbore, the tubing string forming a first annulus between an exterior of the tubing string and a subterranean formation;

filtering, by a first filter screen coupled to the exterior of the tubing string, fluid between the first annulus and a second annulus formed between the first filter screen and the exterior of a first tubing joint of the tubing string;

filtering, by a second filter screen coupled to the exterior of a second tubing joint of the tubing string, fluid between the first annulus and a third annulus formed between the second filter screen and the exterior of the second tubing joint;

forming, by a shroud positioned on the exterior of the tubing string, a fluidic pathway between the second annulus and the third annulus, the shroud being coupled at a first end to the first filter screen and being coupled at a second end to the second filter screen; and controlling, by an interval control valve positioned inline with the exterior of the tubing string, a flow path of the fluid between the second annulus and an interior of the tubing string.

11. The method of claim 10, further comprising:

deploying a first packer in the first annulus uphole from the first filter screen and the interval control valve;

deploying a second packer in the first annulus downhole from the first filter screen and the interval control valve; and forming, by the first packer and the second packer, a fluid isolation zone for the first annulus and the second annulus.

12. The method of claim 11, wherein the flow path is a first flow path and the interval control valve is a first interval control valve, and wherein the method further comprises:

filtering, by a third filter screen coupled to a same tubing joint of the tubing string as the first filter screen, fluid between the first annulus and a fourth annulus formed between the third filter screen and the exterior of the tubing string; and controlling, by a second interval control valve positioned inline with the exterior of the tubing string, a second flow path of the fluid between the fourth annulus and the interior of the tubing string, wherein the third filter screen and the second interval control valve are within the fluid isolation zone between the first packer and the second packer.

13. The method of claim 10, further comprising:

controlling, by one or more control lines extending from a surface of the wellbore to the interval control valve, actuation of the interval control valve to control flow of fluid into the tubing string.

14. The method of claim 10, wherein the shroud further comprises filter openings or slots.

15. The method of claim 10, further comprising:

positioning a gravel pack downhole within the first annulus between the subterranean formation and the first filter screen.

16. An interval control valve system comprising:

a first filter screen coupleable to an exterior of a first tubing joint of a tubing string that is positionable downhole in a wellbore, the tubing string configurable to form a first annulus between the exterior of the tubing string and a subterranean formation when positioned downhole, the first filter screen configurable to form a second annulus between the first filter screen and the exterior of the tubing string;

an interval control valve positionable inline with the exterior of the tubing string and configurable to control flow of fluid between the second annulus and an interior of the tubing string;

a second filter screen coupleable to the exterior of a second tubing joint of the tubing string and configurable to form a third annulus between the second filter screen and the exterior of the second tubing joint; and a shroud positionable on the exterior of the tubing string, the shroud comprising:

a first end coupleable to the first filter screen; and a second end coupleable to the second filter screen to form a fluidic pathway between the second annulus and the third annulus.

17. The interval control valve system of claim 16, wherein a first packer and a second packer are configurable to form a fluid isolation zone for the first annulus and the second annulus, wherein the first packer is positionable in the first annulus uphole from the first filter screen and the interval control valve, and wherein the second packer is positionable in the first annulus downhole from the first filter screen and the interval control valve.

18. The interval control valve system of claim 17, wherein the interval control valve is a first interval control valve, wherein the first interval control valve is configurable to control a first flow path of fluid between the second annulus and the interior of the tubing string, and wherein the interval control valve system further comprises:

a third filter screen coupleable to a same tubing joint of the tubing string as the first filter screen, wherein a fourth annulus is formed between the third filter screen and the exterior of the tubing string, wherein the third filter screen is configurable to filter fluid between the first annulus and the fourth annulus; and a second interval control valve positioned inline with the exterior of the tubing string and configurable to control a second flow path of fluid between the fourth annulus and the interior of the tubing string, wherein the third filter screen and the second interval control valve are positionable within the fluid isolation zone between the first packer and the second packer.

19. The interval control valve system of claim 16, further comprising:

one or more control lines extendable from a surface of the wellbore to the interval control valve positionable downhole in the wellbore, wherein the one or more control lines are configurable to control actuation of the interval control valve.

20. The interval control valve system of claim 16, wherein the shroud further comprises filter openings or slots.

* * * * *